US005620249A

United States Patent [19]

Musil

[11] Patent Number: 5,620,249

[45] Date of Patent: Apr. 15, 1997

[54] COMPACT ENCLOSABLE ASPHALT PLANT

[75] Inventor: Joseph E. Musil, Ely, Iowa

[73] Assignee: Cedarapids, Inc., Cedar Rapids, Iowa

[21] Appl. No.: 715,653

[22] Filed: Sep. 18, 1996

[51] Int. Cl.[6] ..... B28C 5/46

[52] U.S. Cl. ..... 366/25; 366/62; 34/136; 34/137

[58] Field of Search ..... 366/7, 18, 19, 366/20, 22–25, 38, 62, 63, 147, 349; 34/82, 135–137, 140; 432/103, 105, 106, 108, 111, 113, 117

[56] References Cited

U.S. PATENT DOCUMENTS

| | | | |
|---|---|---|---|
| D. 255,355 | 6/1980 | Mize et al. . | |
| 3,251,140 | 5/1966 | Fraenzel | 432/117 X |
| 4,103,350 | 7/1978 | Brock et al. . | |
| 4,211,490 | 7/1980 | Brock et al. . | |
| 4,477,250 | 10/1984 | Brashears et al. . | |
| 4,600,379 | 7/1986 | Elliott . | |
| 4,616,934 | 10/1986 | Brock . | |
| 4,638,747 | 1/1987 | Brock et al. | 366/25 X |
| 4,715,720 | 12/1987 | Brock . | |
| 4,802,139 | 1/1989 | Sasaki | 366/25 X |
| 5,085,581 | 2/1992 | Mendenhall | 432/106 X |
| 5,090,831 | 2/1992 | McFarland et al. | 366/25 X |
| 5,152,233 | 10/1992 | Spisak . | |
| 5,199,354 | 4/1993 | Wood . | |
| 5,209,563 | 5/1993 | Swisher, Jr. et al. | 366/22 |
| 5,352,275 | 10/1994 | Nath et al. . | |
| 5,383,725 | 1/1995 | Swisher, Jr. et al. | 366/22 |

*Primary Examiner*—Charles E. Cooley

*Attorney, Agent, or Firm*—Simmons, Perrine, Albright & Ellwood, P.L.C.

[57] ABSTRACT

A compact, enclosable plant for producing hot mix asphalt from various ingredients, including recycle asphalt pavement ("RAP"). The system includes an inclined rotary drum, a burner assembly for generating a hot gas stream within the drum; a baghouse, exhaust blower, and stack mounted above the drum for reclaiming entrained particulate matter; an auger arrangement for returning the reclaimed particulate matter to the: and a supporting frame. The baghouse has a lower chamber for collecting the reclaimed particulate matter and for serving as a primary hopper for certain of the various ingredients. A plurality of preferably rectangularly shaped storage and loadout silos for containing certain of the ingredients and the hot mix asphalt, and conveyors for conveying the certain ingredients and hot mix asphalt to and from the storage and loadout silos, and to a bypass chute for direct loading on transport vehicles. The system is compact such that lengths of conveyors and ducting interconnecting the baghouse and drum can be minimized, and such that the system can be enclosed to minimize noise and odor pollution and to provide an esthetic appearance. The system may be configured in either a counterflow configuration or a parallel flow configuration.

19 Claims, 4 Drawing Sheets

COMPACT ENCLOSABLE ASPHALT PLANT

BACKGROUND OF THE INVENTION

1. Field of the Invention

The present invention relates generally to a plant for producing asphalt products and, particularly, without limitation, to such a plant comprising a rotary drum dryer/mixer for producing hot mix asphalt and a baghouse for removing airborne contaminants from a hot gas stream discharged from the rotary drum.

2. Description of the Related Art

Asphalt plants for producing hot mix asphalt products are notorious for generating greater or lesser amounts of environmental pollution, including thermal, noise, odor and esthetic pollution. Although significant improvements have been realized in attempts to reduce and contain such pollution below certain allowable minimums, sufficient residual pollution remains whereby asphalt plants are generally perceived to constitute undesirable nuisances in the community, particularly near residential developments.

As indicated, part of the problem with asphalt plants is esthetic pollution. The visual impact provided by a big, ugly plant having various components spread out horizontally from each other and interconnected by various conveyors and ductwork is anything but attractive. In addition, the interconnecting conveyors and ductwork enhances the opportunities for undesirable odors, etc., to be released to the surrounding environment even though such leakages may be sufficiently diluted to remain below allowable minimums.

What is needed is a system for producing hot mix asphalt wherein the various components can be arranged relative to each other such that the interconnecting conveyors and ductwork can be minimized to thereby reduce or eliminate opportunities for leakage of various pollutants, and such that the system can be compactly configured and enclosed to thereby provide a more esthetic and pleasing appearance to the surrounding community.

SUMMARY OF THE INVENTION

An improved system is provided for a compact, enclosable plant for producing hot mix asphalt from various ingredients, including recycle asphalt pavement ("RAP"). The system includes processing means for producing the hot mix asphalt from the various ingredients wherein the processing means includes an inclined rotary drum, a burner assembly for generating a hot gas stream within the drum, an exhaust arrangement for exhausting the hot gas stream including any particulate matter entrained therein from the drum; a filtering arrangement including a baghouse for reclaiming the entrained particulate matter from the hot gas stream exhausted from the drum: a return arrangement for returning the reclaimed particulate matter to the drum for use as one of the various ingredients for producing the hot mix asphalt; and a supporting frame arrangement for supporting the various components of the system.

The filtering arrangement includes an exhaust duct connecting the drum to the baghouse, and the returning arrangement includes a screw conveyor configured to remove the reclaimed particulate matter from the baghouse, another screw conveyor extending axially into the drum, and a conduit communicatively coupling those two screw conveyors together. The baghouse is mounted above the drum such that the lengths of each of the exhaust duct and the conduit spaced exteriorly to the baghouse and the drum, and such that the length normally required to meet code height requirements of an exhaust stack of the baghouse, are minimized. Also, a blower of the filtering arrangement is mounted beside the baghouse such that the length of a communicative coupling therebetween is minimized.

The baghouse has a chamber configured to operably collect the particulate matter being reclaimed by the filter means and to operably provide a hopper for temporarily containing certain of the various ingredients for producing the hot mix asphalt.

The system also includes a plurality of preferably rectangularly shaped storage silos configured to operably contain certain of the ingredients for producing the hot mix asphalt, shuttle conveyor arrangements for selectively distributing those ingredients to the storage silos, and weigh conveyor arrangements configured to selectively convey those ingredients form the storage silos to the drum. In addition, the system includes feed bin or bins for recycle asphalt pavement and a weigh conveyor for conveying the recycle asphalt pavement to the drum.

Further, the system includes a plurality of preferably rectangularly shaped loadout silos configured to operably contain asphalt material produced by the system, and a shuttle conveyor arrangement for selectively distributing that asphalt material to the loadout silos or to a bypass chute for direct loading on transport vehicles.

The system includes an enclosure that is configured to enclose the various components of the asphalt plant and to operably minimize transmission and emission of noises, odors, etc., to the surrounding environment.

The system may be configured in either a counterflow configuration or a parallel flow configuration.

PRINCIPAL OBJECTS AND ADVANTAGES OF THE INVENTION

The principal objects and advantages of the present invention include: providing an asphalt plant having a baghouse mounted above a rotary drum; providing such an asphalt plant that is compact and enclosable; providing such an asphalt plant having rectangularly shaped storage silos; providing such an asphalt plant having rectangularly shaped loadout silos; providing such an asphalt plant that minimizes emissions of nuisance odors: providing such an asphalt plant that reduces noise pollution; providing such an asphalt plant having an exhaust stack that is mounted such that the length thereof can be substantially reduced while still meeting code height minimum requirements: providing such an asphalt plant wherein ducting between a drum and a baghouse is minimized; providing such an asphalt plant wherein conduit between a baghouse and a drum for returning reclaimed particulate matter is minimized: providing such an asphalt plant wherein the length of communicative coupling between a baghouse and an exhaust blower thereof is minimized: providing such an asphalt plant that provides a esthetic appearance to the surrounding environment: and generally providing such an asphalt plant that is reliable in performance, capable of long life, and is particularly well adapted for the proposed usages thereof.

Other objects and advantages of this invention will become apparent from the following description taken in co,junction with the accompanying drawings wherein are set forth, by way of illustration and example, certain embodiments of this invention.

BRIEF DESCRIPTION OF THE INVENTION

DETAILED DESCRIPTION OF THE INVENTION

Figure 2:
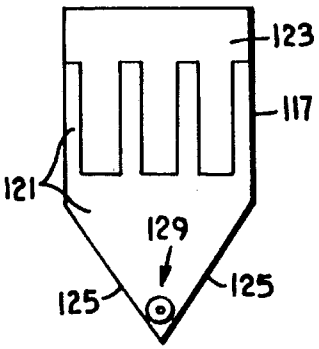
FIG. 2 is a fragmentary, cross-sectional view of a baghouse of the compact, enclosable asphalt plant, taken along line 2–2 of FIG. 1.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a compact, enclosable system for producing hot mix asphalt in accordance with the present invention, as shown in FIGS. 1 through 5. The system 1 generally comprises asphalt processing means 3 including a burner assembly 4, filter means 5, dust return means 7, and storage means 9.

A description is provided immediately herebelow for the system 1 wherein the asphalt processing means 3 has a counterflow configuration. Subsequently, a description is provided for the system 1 wherein the asphalt processing means 3 has a parallel flow configuration.

The asphalt processing means 3 includes a cylindrically shaped rotary drum 13 supported on frame or support means 15 configured to support the various components of the system 1. The frame means 15 generally comprises a pair of spaced apart, parallel beams 17, inclined from a horizontal orientation and supported by vertical legs 19. The legs 19 may be mounted on appropriate foundations 20 for permanent installation, on large flat structural plates (not shown) for non-permanent relocatable installation, or other suitable arrangement.

Figure 1:
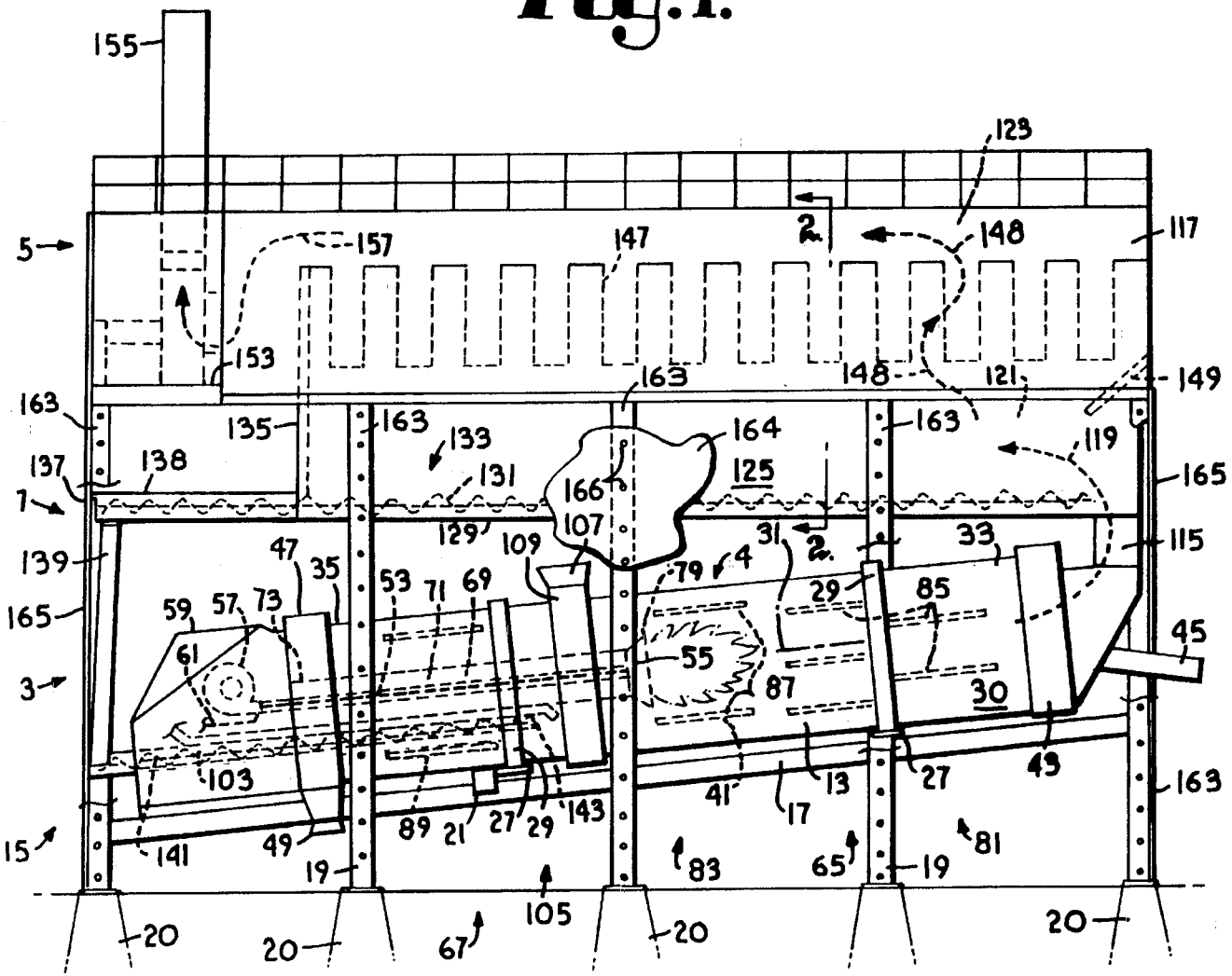
FIG. 1 is a fragmentary, side elevational view of a compact, enclosable asphalt plant for producing hot mix asphalt with portions cut away to reveal details wherein the plant is shown having a counterflow configuration, according to the present invention.

Drive means 21 mounted on the frame means 15, such as motor driven rollers 27 supportingly receiving trunnion rings 29 secured to an exterior wall 30 of the rotary drum 13, as shown in FIG. 1, rotate the drum 13 about a longitudinal axis 31.

The rotary drum 13 has a material input end 33 and a material discharge end 35 which, in conjunction with the wall 30, form a cavity 41 extending within the drum 13 from the material input end 33 to the material discharge end 35. The longitudinal axis 31, about which the rotary drum 13 is rotated, is inclined such that the material input end 33 is elevated above the material discharge end 35. The drum 13 is sufficiently inclined whereby materials being processed through the cavity 41 are gravitationally urged toward and to the material discharge end 35 as the dram 13 is being rotated.

Located at the material input end 33 of the drum 13 is a fixed input housing 43 having a circularly shaped opening configured to rotatably and sealingly receive the material input end 33 of the drum 13 such that the drum 13 is rotatable relative to the input housing 43. A material conveyor 45, such as a conveyor of the fixed or movable slinger-type or other suitable arrangement, penetrates the input housing 43 and extends into the material input end 33 of the drum 13, such that virgin aggregate can be introduced into the cavity 41 of the drum 13 in the vicinity of the material input end 33.

Located at the material discharge end 35 of the drum 13 is a fixed discharge housing 47. The discharge housing 47 includes a circular opening configured to rotatably and sealingly receive the material discharge end 35 of the drum 13 such that the drum 13 is rotatable relative thereto. A discharge chute 49 situated at a lower portion of the discharge housing 47 is configured to discharge materials processed by the drum 13 from the cavity 41 for further processing as desired.

The drum 13 also has a gas discharge end 51. For applications having a counterflow configuration, wherein a hot gas stream generated in the cavity 41, as hereinafter described, and the materials being processed through the cavity 41 flow in opposite directions, the gas discharge end 51 is the same as the material input end 33.

The burner assembly 4, which extends substantially into the cavity 41, includes a primary air tube 53 having a burner head 55 on an innermost end thereof. The burner assembly 4 is supported by the discharge housing 47. The primary air tube 53 is connected to a blower 57 housed in a blower housing 59 situated near the material discharge end 35 of the drum 13. The blower housing 59, among other things, tends to reduce noise levels which would otherwise emanate from the blower 57 to the surrounding area. The blower 57 is structured to force air through the primary air tube 53 to the burner head 55. Disposed generally within the primary air tube 53 is fuel piping 61 connected to an exterior fuel supply (not shown), such as a natural gas line. Air from the blower 57 and fuel from the fuel piping 61 are discharged through the burner head 55 to generate and maintain a flame 63 and a hot gas stream directed longitudinally into the cavity 41 toward the material input end 33. The positioning of the burner head 55, intermediately between the material input end 33 and the material discharge end 35, effectively divides the cavity 41 into a heating zone 65 and a mixing zone 67, as hereinafter described.

The burner assembly 4 also includes an elongate secondary air tube 69 extending into the cavity 41 substantially coextensively with the primary air tube 53. The secondary air tube 69 surrounds, and is spaced apart from, the primary air tube 53 and the burner head 55. The secondary air tube 69 is generally cylindrically shaped, having a longitudinal axis coincident with the longitudinal axis of the primary air tube 53 such that an annular region 71 is formed between the secondary air tube 69 and the primary air tube 53, and another annular region, the mixing zone 67, is formed between the secondary air tube 69 and the portion of the wall 30 spaced radially outwardly from the secondary air tube 69. It is to be understood, however, that the secondary air tube 69 may have any other desired shape, such as a teardrop shape, etc.

A proximal end 73 of the secondary air tube 69 is configured such that air from the ambient atmosphere can be readily provided through the annular region 71 to provide secondary air to the burner head 55 to support combustion of the flame 63 at the burner head 55. The secondary, air tube 69 is configured whereby atmospheric air provided therethrough maintains the secondary air tube 69 at a temperature that is substantially lower than the temperatures of the materials being processed through the mixing zone 67. As a result, the radially inward extremities of the mixing zone 67, namely the secondary air tube 69, acts as a heat sink rather than as a heat source for materials being processed through the mixing zone 67.

Preferably, a conically shaped cowling 79 is spaced at the inner extremity of the secondary air tube 69 such that effects of radiant heat transfer from the flame 63 back toward the mixing zone 67 are substantially reduced or, perhaps, entirely eliminated. If desired, the primary air tube 53 may also have a cowling (not shown) to provide some shielding of the cowling 79 from the flame 63. The arrangement of the secondary air tube 69 in conjunction with the sealing arrangement between the drum 13 and the discharge housing 47, hereinbefore mentioned, essentially eliminates movement of air through the mixing zone 67, either toward or away from the heating zone 65.

In other words, the cooperative configurations of the secondary air tube 69 including the cowling 79 and the provision of atmospheric air longitudinally through the annular region 71 of the secondary air tube 69, directing the flame 63 and corresponding hot gas steam upstream from the burner head 55 toward and to the material input end 33 and away from the mixing zone 55, and eliminating air movement through the mixing zone 67 effectively isolate the mixing zone 67, with one exception, from substantially all heating effects of the hot gas stream and the flame 63, including those which could otherwise arise from direct contact with the hot gas stream and the flame 63 and those which could otherwise arise indirectly from the hot gas stream and the flame 63, including radiant, convective and conductive heating effects. The referred-to exception to thermal isolation of the mixing zone 67 is thermal energy contained internally in the ingredients introduced into the mixing zone 67, including virgin aggregate gravitationally urged thereinto from the heating zone 65 fix producing hot mix asphalt, and liquid asphalt, mineral fines and reclaimed particulate matter introduced directly into the mixing zone 67, each of which may internally and desirably contain controlled quantities of thermal energy not arising directly or indirectly from the hot gas stream or the flame 63.

Thus, definition of the term "isolated" as applicable to the mixing zone 67 of the present invention includes not only the particular cooperating arrangement of various components of the system 1 but also includes the admission of desirable effects to the mixing zone 67 and to materials therein, such as internally contained thermal energy, and includes the inadmission of undesirable effects to the mixing zone 67 and to materials therein, such as air movement through the mixing zone 67 and further heating of materials in the mixing zone 67 from sources other than thermal energy contained internally within the materials as they are introduced into the mixing zone 67.

As hereinbefore described, the heating zone 65 portion of the cavity 41 extends from adjacent to the material input end 33 of the drum 13 to just upstream from the burner head 55 and the mixing zone 67 extends from adjacent to the material discharge end 35 of the dram 13 to the vicinity of, but short of and downstream from, the burner head 55. The heating zone 65 may be considered to comprise a drying zone 81 and a combustion zone 83 wherein the drying zone 81 extends from adjacent to the material input end 33 to a point downstream therefrom but beyond the reach of the flame 63, and the combustion zone 83 comprises the remainder of the heating zone 65.

At different regions throughout the interior of the drum 13 and attached to the wall 30 are various types of flightings or paddles for the alternative purposes of lifting, mixing, tumbling, stirring, etc., of material being processed within the cavity 41. The actions of various flightings are known to those skilled in the art and are not discussed here in detail. Without intending to be limiting or exhaustive of the various combinations which could be utilized with the present invention, exemplary workable flighting embodiments could include the following.

In the drying zone 81, flighting 85 may be configured as open-topped bucket flights arranged longitudinally and generally parallel with the axis 31 of the drum 13. Virgin aggregate being gravitationally urged along the drum 13 will be picked up by the bucket flights 85 as the drum 13 is rotated about the axis 31. The virgin aggregate spills from the bucket flights 85 creating veils or curtains of falling virgin aggregate across the cavity 41 as rotation of the drum 13 causes the bucket flights 85 to be arcuately displaced across the upper reaches of the cavity 41.

In the combustion zone 83, flighting 87 may be configured as low-profile combustion flights 87, also generally arranged longitudinally and parallel with the axis 31 of the drum 13. Instead of being lifted and veiled, however, the virgin aggregate being processed by the combustion flights 87 is generally tumbled and turned and mixed across the bottom and along the lower sides of the wall 30 as the drum 13 is rotated.

As in the combustion zone 83, flighting 89 in the mixing zone 67 is generally configured as low-profile flights arranged longitudinally and generally parallel with the axis 31 of the drum 13 such that material being processed in the mixing zone 67 is generally tumbled, turned and mixed instead of being lifted and veiled as in the drying zone 81. As more thorough mixing of materials in the mixing zone 67 is generally required, the flights 89 may be modified to include saw-tooth or other suitable modifications to enhance the desired mixing function of the mixing zone 67.

As hereinbefore described, the mixing zone 67 is situated downstream from the burner head 55, with upstream extremities of the mixing zone 67 being spaced downstream from the burner head 55 and downstream extremities of the mixing zone 49 being spaced adjacent to the material discharge end 35 of the drum 13. Radially outward extremities of the mixing zone 67 are bounded by the wall 30 of the drum 13, and radially inward extremities of the mixing zone 67 are bounded by the secondary air tube 69. The low-profile flighting 89 of the mixing zone 67 allows materials being processed in the mixing zone 67 to remain along the bottom and lower sides of the wall 30 as those materials are gravitationally urged toward and to the discharge chute 49. As the drum 13 rotates, the radially outward extremity of the mixing zone 67, namely the wall 30, is repetitiously cycled through a cooling process as it is rotatively elevated above the materials being processed in the mixing zone 67 where it contacts the ambient atmosphere as it is arcuately displaced over and above the secondary air tube 69.

Due to the elimination of air movement through the mixing zone 67, any volatile components vaporized from the asphaltic components being processed therein quickly recondense and do not leave the mixing zone 67, thereby avoiding burdening the filtering means 5 and/or risking production of blue-smoke contamination.

An asphalt injection tube 103 is mounted generally beneath the secondary air tube 69 within the drum 13 and generally extends through the discharge housing 47. The asphalt injection tube 103 is connected to conventional equipment (not shown) for spraying liquid asphalt in the mixing zone 67 of the drum 13 for producing hot mix asphalt.

If desired, downstream from the burner head 55 is a recycle asphalt input feed assembly 105 by which recycle asphalt pavement ("RAP") may be introduced into the mixing zone 67. The recycle asphalt input feed assembly 105 generally includes a feed hopper 107 and a stationary collar 109, encircling the wall 30 and configured to sealingly receive the drum 13 therethrough such that air movement to and from the cavity 41 through the recycle asphalt input feed assembly 105 is suppressed. The recycle asphalt input feed assembly 105 includes scoops, drum openings, etc. (not shown), or other suitable arrangement, as necessary to convey the RAP into the cavity 41. Preferably the RAP is deposited near the wall 30 in the isolated mixing zone 67, where it is mixed and processed with the other materials therein. Thermal energy from the heated aggregate urged into the mixing zone 67 from the combustion zone 83 is transferred to the RAP and other ingredients generally introduced into the mixing zone 67 near the upstream end thereof such that each of the ingredients is thoroughly processed and mixed to produce hot mix asphalt sufficiently in advance of being discharged from the discharge chute 49.

An exhaust duct 115, connected to the input housing 43, is configured to communicatively connect the cavity 41 to the filter means 5, such as a baghouse 117, to remove airborne particulate matter from the hot gas stream exiting the drum 13, as indicated by the arrow designated by the numeral 119 in FIG. 1. The baghouse 117, which is divided into a lower chamber 121 and an upper chamber 123, is mounted to the frame means 15 such that the baghouse 117 is spaced vertically above the drum 13.

The lower chamber 12 1 of the baghouse 117 has a V-shaped configuration, with sides 125 thereof sloping downwardly and inwardly to a centrally spaced trough 129, as shown in FIG. 1. In addition, the lower chamber 121 has a relatively large volume such that the rapid flow of the gas stream through the drum 13 and the exhaust duct 115 is largely dissipated upon entry into the baghouse 117. As a result, a substantial portion of the airborne particulate matter carried along by the gases of the hot gas stream settles out and glides down the sides 125 to the trough 129.

The dust return means 7 generally includes a screw conveyor or auger 131 mounted within the trough 129 such that the particulate matter that has been reclaimed from the hot gases exhausted from the cavity 41 is conveyed axially along (leftward as viewed in FIG. 1) by the screw conveyor 131, and removed from the lower chamber 121 through an endwall 135 of the lower chamber 121. From the endwall 135 to the vicinity of the leftmost end 137 of the system 1, the auger 131 is generally enclosed in a casing 138 to contain the particulate matter being conveyed there along. Near the end 137, the particulate matter is urged into a generally vertically oriented conduit 139 to convey the reclaimed particulate matter to another screw conveyor 141. The screw conveyor 141 is mounted through the discharge housing 47 and is positioned generally beneath and alongside the secondary air tube 69 and the asphalt injection tube 103 within the drum 13, such that the reclaimed particulate matter is returned to the drum 13 to be used as one of the ingredients for producing the asphalt material. Preferably, the screw conveyor 141 is mounted whereby a distal end 143 thereof can be axially displaced relative to the mixing zone 67 if necessary to selectively alter whereat the reclaimed particulate matter is introduced into the mixing zone 67 with regard to whereat the asphalt injection tube 103 injects the liquid asphalt, for example.

The processing means 3, the filter means 5, and the return means 7 are mounted generally vertically relative to each other by the support means 15. Specifically, the baghouse 117 is mounted above the drum 13 such that the length of the exhaust duct 115 spaced exteriorly to the baghouse 117 and the drum 13 is minimized, and the length of the conduit 139, connecting the conveyors 131 and 141 and spaced exteriorly to the baghouse 117 and the drum 13, is also minimized.

For those applications wherein the reclaimed particulate matter returned to the drum 13 by the dust return means 7 is insufficient to provide the desired quantity thereof for producing the asphalt material, conventional equipment (not shown) may be used for feeding binder material, mineral "fines" and/or previously reclaimed particulate matter to the mixing zone 67. Preferably, such additives are introduced into and delivered into the dram 13 by the conveyor 141, together with the reclaimed particulate matter being conveyed from the baghouse 117. Alternatively, however, another screw conveyor (not shown) may be mounted through the discharge housing 47 for that purpose.

It is foreseen that the lower chamber 121, within limits, may be utilized to store, along with particulate matter being reclaimed, mineral fines, etc., for conveyance back to the drum 13. In other words, the lower chamber 121 may be used as a primary hopper for such ingredients, eliminating the need for a separate primary hopper. The rate of rotation of the auger 131 may be controlled, automatically or manually, in order to regulate the rate at which the reclaimed particulate matter, etc., is conveyed from the lower chamber 121 for dispensing into the mixing zone 67 by the screw conveyor 141.

The upper chamber 123 is separated from the lower chamber 121 by a filter element 147 constructed of fiber material similar to that found in other baghouses, or other suitable material. The gases contained in the lower chamber 121 must pass through the filter element 147 to reach the upper chamber 123, as typically shown by the arrows designated by the numeral 148 in FIG. 1. As the gases passes through the filter element 147, particulate matter, which has not already settled out as hereinbefore described, is filtered out of the gases by the filter element 147. As the particulate matter accumulates on the filter element 147, "cakes" of the filtered particulate matter from time to time fall away from the filter element 147 and drop downwardly against the sides 125 and into the trough 129 to be carried away by the auger 131. If needed, a filter cleaning procedure may be utilized whereby airflow through the filter element 147 is momentarily reversed, causing the filter element 147 to more or less change from a slightly concave surface configuration to a slightly convex surface configuration, thereby causing the caked particulate matter to drop loose from the filter element 147. If desired, a deflector plate 149 may be appropriate placed to prevent falling caked particulate matter from dropping downwardly into the exhaust duct 115.

Exhaust means for exhausting the hot gas stream, including any particulate matter entrained therein, from the drum 13 includes a blower 151 driven by one or a pair of blowers 152 is arranged to draw filtered gases through an opening 153 and exhaust those gases into the ambient atmosphere through a stack 155, as indicated by the dotted arrow designated by the numeral 157.

Figure 4:
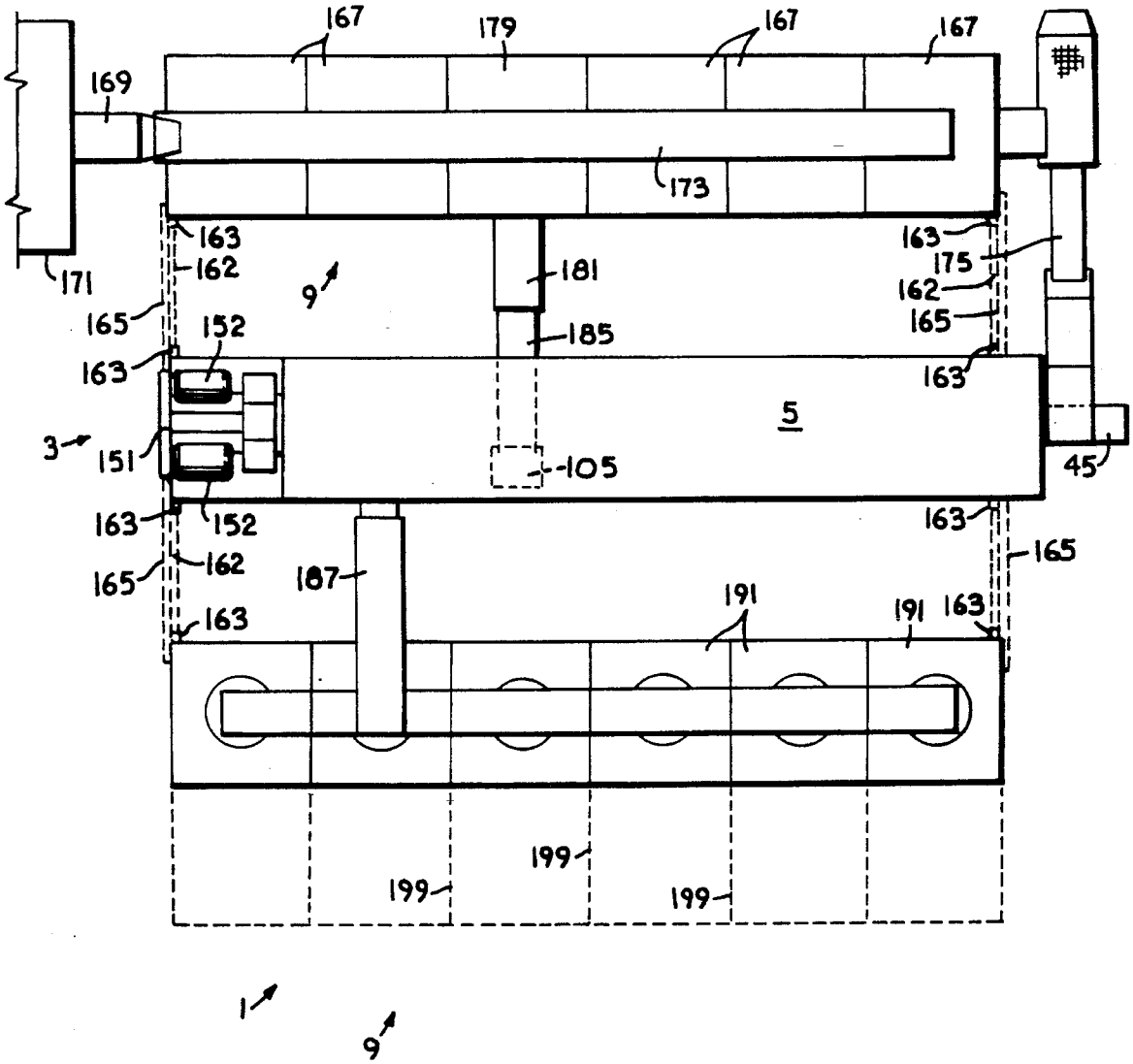
FIG. 4 is a to fragmentary, plan view of the compact, enclosable asphalt plant, similar to FIG. 3 but showing rectangularly shaped storage and loadout silos.

The portion of the frame means 15 supporting the baghouse 117 generally comprises vertically oriented, generally rectangularly shaped structural columns 163. Side panels 164 and end panels 165 are secured to the columns 163, such as by self-tapping bolts 166 or other suitable fasteners, to enclose the system 1, including the drum 13, etc., to reduce noise emission and to provide a more esthetic appearance to the surrounding environment. If desired, the panels 164 and 165 may be structured to enhance sound dampening thereof, may have sound deadening layers 162 laminated thereto as shown in FIG. 4, and/or may utilize other suitable arrangements for minimizing or eliminating sound or odor nuisances that might otherwise to transmitted or transported, such as by breezes, to the surrounding environment.

An obvious benefit provided by mounting the baghouse 117 above the drum 13 is the elimination of substantial, externally exposed ductwork generally required by prior art asphalt plants in order to conduct the exhausted hot gas stream to baghouses disposed horizontally from the drums thereof. By spacing the baghouse 117 above the drum 13 as taught by the present invention, the effective length of the ducting for directing the hot gas stream from the gas discharge end 51 of the drum 13 to the baghouse 117, namely the exhaust duct 115, is minimized. Even then, the exhaust duct 115 is not externally exposed for applications utilizing the side panels 164 and the end panels 165.

Also, exhaust fans of prior an plants are generally mounted at or near ground level. As a result, another benefit provided by the present invention is the mounting of the blower 151 beside the baghouse 117, thereby eliminating such prior art ductwork. In other words, the blower 151 is communicatively coupled to the baghouse 117 at an end thereof such that the length of the coupling is minimized. Again, mounting the baghouse 117 above the drum 13 reduces the physical length which the stack 155 must have in order to meet code elevational requirements relative to surrounding terrain.

Another benefit provided by mounting the baghouse 117 above the drum 13 is the elimination of substantial, externally exposed, screw auger conveyors generally required by prior art asphalt plants for conveying reclaimed particulate matter from a baghouse back to a drum horizontally disposed therefrom. By spacing the baghouse 117 above the drum 13 as taught by the present invention, the effective length of the ducting for directing the reclaimed particulate matter back to the drum 13, namely that of the conduit 139, is minimized. Again, the conduit 139 is not externally exposed for applications wherein the plant 1 is enclosed by the side panels 164 and the end panels 165.

A plurality of storage silos 167 may be used to store virgin aggregate for producing the asphalt material. For stocking the storage silos 167, an elevator 169 elevates the virgin aggregate from a truck/loader dump hopper 171 to a translational shuttle conveyor 173, which is arranged to selectively distribute the virgin aggregate to the storage silos 167. A weigh conveyor 175 is arranged to control and convey desired quantities of the virgin aggregate from the storage silos 167 to the drum 13, as indicated by the arrow designated by the numeral 177.

Similarly, one or more feed bins 179 are arranged relative to another weigh conveyor 181 for storing, controlling and conveying desired quantities of RAP material for producing the asphalt material, as indicated by the arrow designated by the numeral 183. An elevator 185 is used to elevate the RAP material for introduction into the mixing zone 67 through the recycle asphalt input feed assembly 105.

Figure 3:
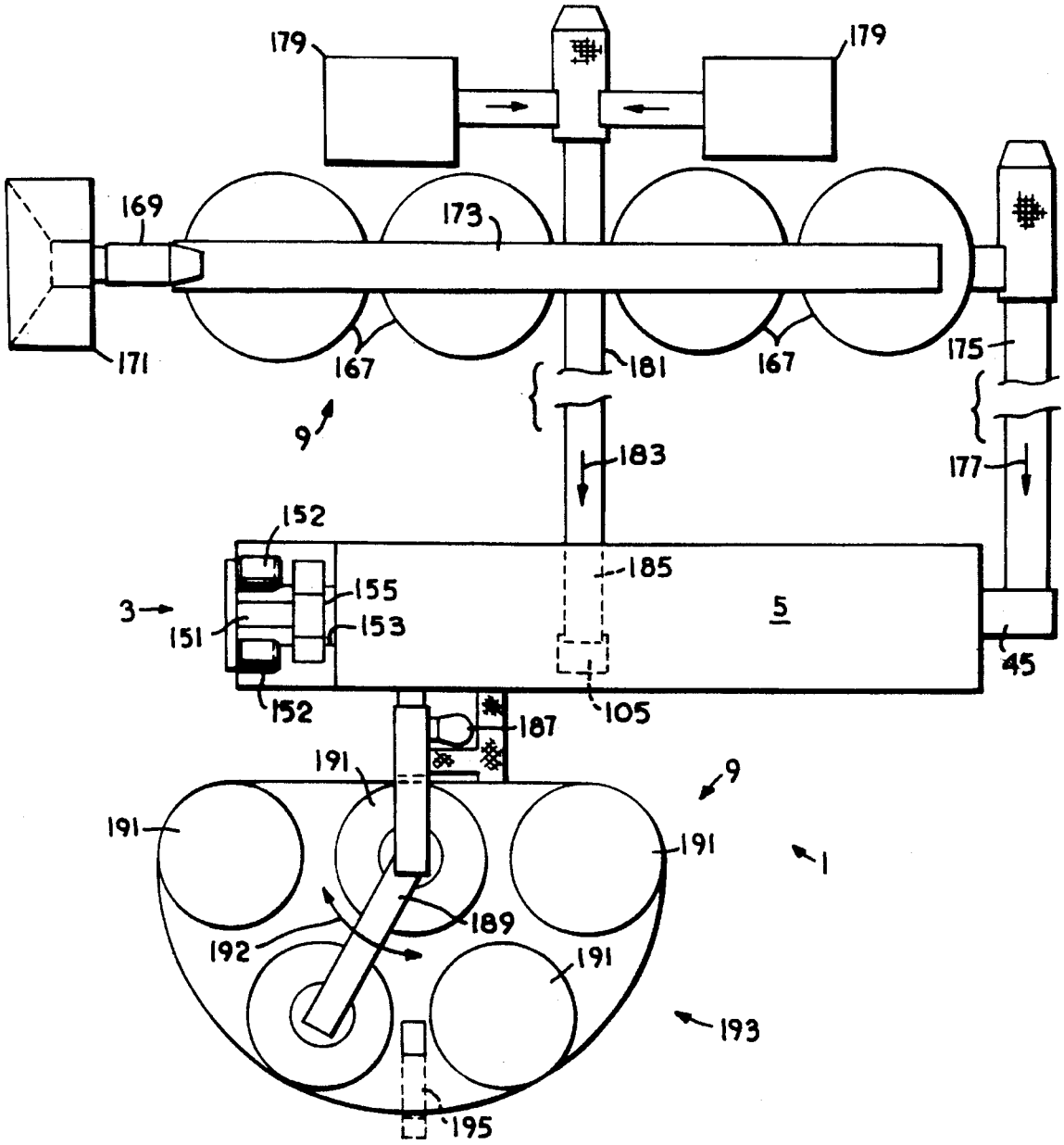
FIG. 3 is a fragmentary, plan view of the compact, enclosable asphalt plant, showing interconnecting conveyors and cylindrically shaped storage and loadout silos thereof.

As asphalt material is discharged from the drum 13, the asphalt material is elevated by a bucket elevator 187 to a pivoting shuttle conveyor 189 for distribution to a plurality of loadout silos 191, as indicated by the double headed arrow designated by the numeral 192 in FIG. 3. To minimize space, the loadout silos 191 may be arranged in a semicircular arrangement 193, with a bypass chute 195 for direct loading onto transport vehicles (not shown).

To further minimize space requirements and to make the system 1 even more compact, the storage silos 167 and/or the loadout silos 191 may be constructed with square or rectangularly shaped cross-sections such that the silos 167 and 191 may be spaced in side-by-side abutting relation, as shown in FIG. 4. If desired, one or more of the rectangularly shaped containers may be used for the RAP feed bin 179. Such rectangularly shaped configurations may be even more important for applications requiring greater numbers of the storage silos 167 and/or the loadout silos 191. For example, minimal additional area is required to provide a second row of the loadout silos 191, as suggested by the phantom lines designated by the numeral 199 in FIG. 4.

The storage silos 167 and the loadout silos 191 having rectangularly shaped cross-sections makes the system 1 particularly adaptable to enclosure of the silos 167 and 191, together with the other components of the system 1 as hereinbefore described, within the frame means 5 such that the side panels 164, the end panels 165, and the deadening layers 162 can be utilized to minimize or eliminate sounds and odors emanating from the system 1 to the surroundings, as indicated in FIG. 4.

Figure 5:
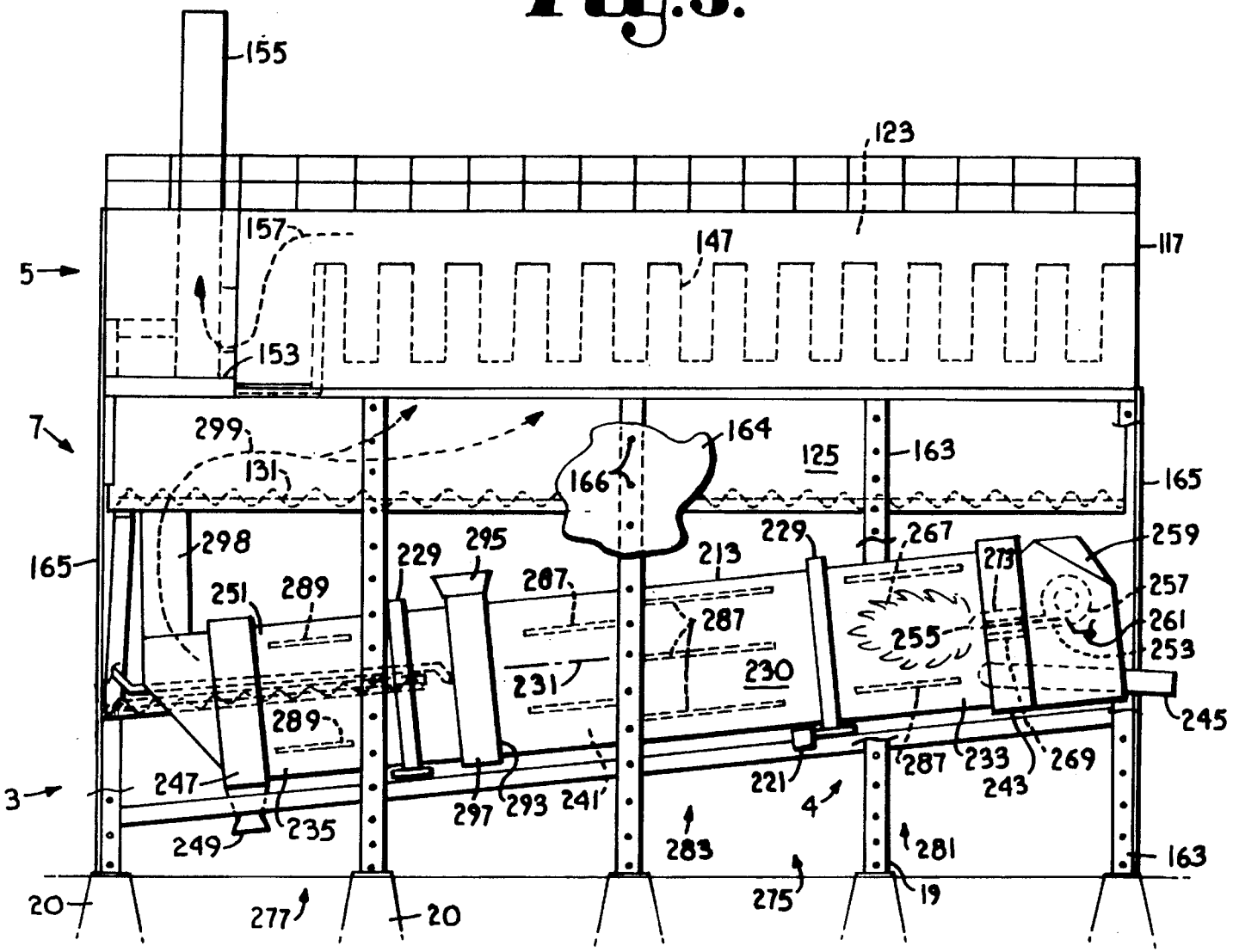
FIG. 5 is a fragmentary, side elevational view of the compact, enclosable asphalt plant, similar to FIG. 1 but showing the plant having a parallel flow configuration, according to the present invention.

The following discussion pertains to applications of the present invention wherein the system 1 has a parallel flow configuration, as shown in FIG. 5. The same element numbers as used in the previous discussion, relating to the counterflow configuration, may be repeated to identify substantially similar elements, if appropriate.

The system 1, wherein the asphalt processing means 3 has a parallel flow configuration, includes a cylindrically shaped rotary drum 213 supported on the frame means 15 configured to support the various components of the system 1. Drive means 221 mounted on the frame means 15, such as motor driven rollers 227 supportingly receiving trunnion rings 229 secured to an exterior wall 230 of the rotary drum 213 as shown in FIG. 5, rotate the drum 213 about a longitudinal axis 231.

The rotary drum 213 has a material input end 233 and a material discharge end 235 which, in conjunction with the wall 230, form a cavity 241 extending within the drum 213 from the material input end 233 to the material discharge end 235. The longitudinal axis 23 1, about which the rotary drum 213 is rotated, is inclined such that the material input end 233 is elevated above the material discharge end 235. The drum 213 is sufficiently inclined whereby materials being processed through the cavity 241 are gravitationally urged toward and to the material discharge end 235 as the drum 213 is being rotated.

Located at the material input end 233 of the drum 213 is a fixed input housing 243 having a circularly shaped opening configured to rotatably and sealingly receive the material input end 233 of the drum 213 such that the drum 213 is rotatable relative to the input housing 243. A material conveyor 245, such as a conveyor of the slinger-type or other suitable arrangement, penetrates the input housing 243 and extends into the material input end 233 of the drum 213, such that virgin aggregate is introduced into the cavity 241 of the drum 213 in the vicinity of the material input end 233.

Located at the material discharge end 235 of the drum 213 is a fixed discharge housing 247. The discharge housing 247 includes a circular opening configured to rotatably and sealingly receive the material discharge end 235 of the drum 213 such that the drum 213 is rotatable relative thereto. A discharge chute 249 situated at a lower portion of the discharge housing 247 is configured to discharge materials processed by the dram 213 from the cavity 241 for further processing as desired.

The drum 213 also has a gas discharge end 251. For applications having a parallel flow configuration, wherein the hot gas stream generated in the cavity 241 and the materials being processed through the cavity 241 flow in the same direction, the gas discharge end 251 is the same as the material discharge end 235.

The burner assembly 4, which extends into the cavity 241, generally includes a primary air tube 253 having a burner head 255 on an innermost end thereof. The burner assembly 4 is supported by the input housing 243. The primary air tube 253 is connected to a blower 257 housed in a blower housing 259 situated near the material input end 233 of the drum 213. The blower housing 259, among other things, tends to reduce noise levels which would otherwise emanate from the blower 257 to the surrounding area. The blower 257 is structured to force air through the primary air tube 253 to the burner head 255. Disposed generally within the primary air tube 253 is fuel piping 261 connected to an exterior fuel supply (not shown), such as a natural gas line. Air from the blower 257 and fuel from the fuel piping 261 are discharged through the burner head 255 to maintain a flame 267 directed longitudinally into the cavity 241 toward the material discharge end 235.

The burner assembly 4 also generally includes a secondary air tube 269, extending into the cavity 241 generally coextensive with the primary air tube 253. The secondary air tube 269 generally surrounds, and is spaced apart from, the primary air tube 253. A proximal end 273 of the secondary air tube 269 is positioned such that secondary air can be readily provided from the ambient atmosphere to the burner head 255 to support combustion of the flame 267. It is to be understood, however, that spacing of the secondary air tube 269 relative to the primary air tube 253 may have a variety of spatial and configurational relationships as the parallel flow configuration does not have a mixing zone that is isolated in the manner described for the mixing zone 67 of the counterflow configuration.

Although inner zonal boundaries are not sharply defined, the cavity 241 for the parallel flow configuration can be described as having a heating zone 275 and a mixing zone 277. The heating zone 275 extends from adjacent to the material input end 233 of the drum 213 to a region downstream therefrom whereat heating effects, due to interactions of the flame 267 and the hot gas stream with the virgin aggregate being processed through the drum 213, are substantially reduced. The mixing zone 277 extends from adjacent to the material discharge end 235 of the drum 213 to the heating zone 275. The heating zone 275 may be considered to comprise a first or combustion zone 281 and a second or veiling zone 283 wherein the first zone 281 extends from adjacent to the material input end 233 to a region downstream therefrom but beyond the reach of the flame 267, and the second zone 283 comprises the remainder of the heating zone 275.

At different regions throughout the interior of the drum 213 and attached to the wall 230 are various types of flightings or paddles for the alternative purposes of lifting, mixing, tumbling, stirring, etc., of material being processed within the cavity 241. The actions of various flightings are known to those skilled in the art and are not discussed here in detail. Without intending to be limiting or exhaustive of the various combinations which could be utilized with the present invention, exemplary workable flighting embodiments could include the following.

In the first zone 281, flighting 285 may be configured as low-profile combustion flights 285, generally arranged longitudinally and parallel with the axis 231 of the dram 213. The virgin aggregate being processed by the combustion flights 285 is generally tumbled and turned and mixed along the wall 230 as the drum 213 is rotated to avoid extinguishing the flame 267 by material that might otherwise fall through the flame 267 if other types of flighting were used in the first zone 281.

In the second zone 283, flighting 287 may be configured as bucket flights 287 arranged longitudinally and generally parallel with the axis 231 of the drum 213. Virgin aggregate being gravitationally urged along the drum 213 will be picked up by the bucket flights 287 as the dram 213 is rotated about the axis 231. The virgin aggregate spills from the bucket flights 287 creating veils or curtains of falling virgin aggregate across the cavity 241 as rotation of the drum 213 causes the bucket flights 287 to be arcuately displaced across the upper reaches of the cavity 241.

As in the first zone 281, flighting 289 in the mixing zone 277 is generally configured as low-profile flights 289 arranged longitudinally and generally parallel with the axis 231 of the drum 213 such that material being processed in the mixing zone 277 is generally tumbled, turned and mixed instead of being lifted and veiled. As more thorough mixing of materials in the mixing zone 277 is generally required, the flights 289 may be modified to include saw-tooth or other suitable modifications to enhance the desired mixing function of the mixing zone 277.

An asphalt injection tube 291 is mounted within the drum 213, extending through the discharge housing 247. The asphalt injection tube 291 is connected to conventional equipment (not shown) for spraying liquid asphalt in the mixing zone 277 of the drum 213 for producing hot mix asphalt.

If desired, a recycle asphalt input feed assembly 293 by which RAP may be introduced into the mixing zone 277. The recycle asphalt input feed assembly 293 generally includes a feed hopper 295 and a stationary collar 297, encircling the wall 230 and configured to sealingly receive the drum 213 therethrough. The recycle asphalt input feed assembly 293 includes scoops, drum openings, etc. (not shown), or other suitable arrangement, as necessary to convey the RAP into the cavity 241. Preferably, the RAP is deposited near the wall 230 in the mixing zone 277, where it is mixed and processed with the other materials therein.

The RAP along with the other ingredients introduced into the mixing zone 277 are combined with the virgin aggregate sufficiently upstream from the material discharge end 235 such that each of the ingredients can be thoroughly processed and mixed to produce hot mix asphalt sufficiently in advance of being discharged but, at the same time, are introduced sufficiently downstream from the first zone 281 such that the heating effects of the flame 267 and the hot gas stream do not uncontrollably generate "blue smoke" or detrimentally affect ingredients containing asphaltic compounds. It is to be understood that for any particular application, hot mix asphalt produced by the system 1 may include or not include recycle asphalt material, as desired. For the various considerations discussed herein, it should be obvious to those having skill in the art that applications employing RAP as an ingredient preferably utilize the counterflow configuration as opposed to the parallel flow configuration.

An exhaust duct 298, connected to the discharge housing 247, is configured to communicatively connect the cavity 241 to the filtering means 5, such as the baghouse 117, to remove airborne particulate matter from the hot gas stream exiting from the drum 213, as indicated by the dashed arrow designated by the numeral 299 in FIG. 5. Details regarding the parallel flow configuration concerning the filtering means 5, dust return means 7, storage means 9, etc., are similar to those hereinbefore described for the counterflow configuration.

The following discussion is particularly applicable to asphalt plants having counterflow configurations as hereinbefore described. Modifications to the following discussion for an appropriate description of the systems I having parallel flow configurations should now be apparent to those having skill in the art.

In an application of the present invention, air from the blower 57 is forced through the burner head 55, generating a radiant flame 63 directed into the combustion zone 83. The flame 63 and forced air from the blower 57 causes a hot gas stream to be directed upstream from the burner head 55. In addition to other benefits, positioning the burner head 55 well within the confines of the cavity 41 and the blower 57 within the blower housing 59 substantially reduces noise pollution in the area surrounding the drum 13. The hot gas stream generated by the flame 63 at the burner head 55 flows from the burner head 55 upstream through the cavity 41 toward and through the material input end 33 of the drum 13. The gas stream and any particulate matter entrained therein pass through the exhaust duct 115 to the baghouse 117, where the particulate matter is removed from the exhausted gas by fabric filtration or other suitable means.

Virgin aggregate is conveyed from the storage silos 167 and introduced into the drying zone 81 of the cavity 41 by the conveyors 45 and 175 as the drum 13 is rotated by the drive means 21. The inclined orientation of the drum 13 causes the virgin aggregate to be gravitationally urged successively through the drying zone 81, the combustion zone 83, and the mixing zone 67.

As the virgin aggregate is gravitationally urged through the drying zone 81, the bucket flights 85 lift and drop the virgin aggregate to create a curtain of falling aggregate across the interior of the drum 13 such that the virgin aggregate is dried and heated to an elevated temperature by the hot gas stream flowing therethrough. The heated and dried virgin aggregate is delivered from the drying zone 81 to the combustion zone 83.

The combustion flights 87 in the combustion zone 83 largely confine the virgin aggregate to the floor and lower sides of the wall 30 of the drum 13 to ensure that the flame 63 is not extinguished. The virgin aggregate, however, is still exposed to the radiant heat flux of the flame 63, but the combustion flights 87 generally prevent discharge of the virgin aggregate directly through the visible portion of the flame 63.

Residence time of the virgin aggregate while passing through the heating zone 65 is designed whereby thermal energy absorbed by and stored in the virgin aggregate in the drying zone 81 in combination with additional heating acquired en route through the combustion zone 83, is sufficient to process the recycle material together with the other ingredients introduced into the mixing zone 67 to produce quality hot mix asphalt having a desired design mix. Heat output from the burner head 55 may be monitored and adjusted to respond to changes in material characteristics and feed ratios of the virgin aggregate, the recycle asphalt material, etc.

After exiting from the combustion zone 83, the heated aggregate enters the mixing zone 67. Recycle asphalt material is conveyed from the feed bins 179 and is introduced into the mixing zone 67 through the feed hopper 107 and the recycle asphalt input feed assembly 105 by the weigh conveyor 181. It should be recalled that the mixing zone 67 is isolated by the interrelated and cooperating arrangement of various components and features of the system 1 as hereinbefore described wherein the thermal energy effectively available for producing hot mix asphalt in the mixing zone 67 is available only from the thermal energy contained internally within the ingredients delivered into the mixing zone 67.

Reclaimed particulate matter from the baghouse 117 and dust binder and/or mineral fines, etc., are delivered into the mixing zone 67 by the screw conveyor 141 or other similar arrangement while liquid asphalt is sprayed into the mixing zone 67 by the asphalt injection tube 103. The virgin aggregate, recycle asphalt material, etc., are mixed and stirred by the low-profile flights 89 in the mixing zone 67. The aggregate, reclaimed particulate matter, recycle asphalt pavement, liquid asphalt, etc., after being combined to form a desired hot mix asphaltic composition, are directed to the discharge chute 49 and either conveyed to the loadout silos 191 for temporary storage, or to the bypass chute 195 for direct loading on a transport vehicle.

It is to be understood that greater percentages of recycle asphalt pavement used to produce hot mix asphalt require the virgin aggregate exiting from the combustion zone 83 and entering the mixing zone 67 to have higher temperatures in order to properly process the recycle asphalt material. For example, if hot mix asphalt is to be produced without recycle asphalt material, the temperature of the dried and heated virgin aggregate as it exits the drying zone 81 and enters the combustion zone 83 may have a temperature range of 150–300° F. The temperature of that virgin aggregate as it progresses through the combustion zone 83 will generally increase approximately another 100° F. Thus, the temperature of the virgin aggregate as it exits the combustion zone 83 and enters the mixing zone 67 may have a temperature range of approximately 250°–350° F.

The increase in temperature acquired in a particular zone of the system 1 is, as known by those having skill in the art, dependant upon a variety of factors, such as the speed of rotation of the drum 13, the magnitude of the incline of the drum 13, the quantities of materials added to a particular zone and to zones preceding that zone, the thermal output of the burner assembly 4, the ambient temperature, etc.

If hot mix asphalt is to be produced with recycle asphalt pavement, the temperature of the dried and heated virgin aggregate as it enters the mixing zone 67 depends on the ratio of recycle asphalt pavement to the remainder of the ingredients used for producing the hot mix asphalt. Generally, the ratio of recycle asphalt pavement may range up to fifty percent thereof, depending on the availability of recycle asphalt pavement and the application for which the hot mix asphalt is to be used. For example, if a hot mix asphalt application uses fifty percent recycle asphalt pavement, the virgin aggregate exiting from the drying zone 81 and entering the combustion zone 83 may have a temperature range of approximately 350°–450° F., which may increase approximately another 200° F. as it progresses through the combustion zone 83. Thus, the temperature of the virgin aggregate as it exits the combustion zone 83 and enters the mixing zone 67 may have a temperature of approximately 6500 F. to provide the thermal energy needed to process the recycle asphalt materials in the mixing zone 67.

It is to be understood that while certain forms of the present invention have been illustrated and described herein, it is not to be limited to the specific forms or arrangement of pans described and shown.

What is claimed and desired to be secured by Letters Patent is as follows:

1. A compact system for producing hot mix asphalt from various ingredients, comprising:

(a) processing means for producing the hot mix asphalt from the various ingredients, said processing means including an inclined rotary drum, a burner assembly for generating a hot gas stream within said drum, and exhaust means for exhausting said hot gas stream, including any particulate matter entrained therein, from said drum;

(b) filter means, including a baghouse, for reclaiming said entrained particulate matter from said hot gas stream exhausted from said drum by said exhaust means;

(c) return means for returning said particulate matter reclaimed by said filter means to said drum for use as one of the various ingredients for producing the hot mix asphalt; and (d) support means for supporting said processing means, said filter means and said return means generally vertically relative to each other.

2. The system according to claim 1, wherein:

(a) said filter means includes an exhaust duct connecting said drum to said baghouse; and (b) said baghouse is mounted above said drum such that the length of said exhaust duct spaced exteriorly to said baghouse and said drum is minimized.

3. The system according to claim 1, wherein said return means includes:

(a) a first screw conveyor to remove said reclaimed particulate matter from said baghouse;

(b) a second screw conveyor extending axially into said drum; and (c) a conduit communicatively coupling said first and second screw conveyors.

4. The system according to claim 3, wherein said baghouse is mounted above said drum such that the length of said conduit spaced exteriorly to said baghouse and said drum is minimized.

5. The system according to claim 1, including:

(a) a blower; and (b) a coupling communicatively coupling said blower to said baghouse such that gases from said hot gas stream are exhausted therefrom; said coupling supported by said support means at one end of said baghouse such that the length of said coupling is minimized.

6. The system according to claim 5, wherein said filter means includes a stack mounted above said drum such that the length of the stack required to meet code height requirements is substantially reduced.

7. The system according to claim 1, wherein said processing means has a counterflow configuration.

8. The system according to claim 1, wherein said processing means has a parallel flow configuration.

9. The system according to claim 1, wherein said baghouse has a chamber configured to operably collect said particulate matter being reclaimed by said filter means and to operably provide hopper means for temporarily containing certain of the various ingredients for producing the hot mix asphalt.

10. The system according to claim 1, including enclosure means, mounted on said support means, for enclosing said processing means, said filter means, and said return means.

11. The system according to claim 10, wherein said enclosure means is configured to operably minimize transmission to surroundings of said processing means, said filter means and said return means of emitted noises and odors thereof.

12. The system according to claim 1, including recycle asphalt input means for introducing recycle asphalt pavement into said processing means for use as one of the various ingredients for producing the hot mix asphalt.

13. The system according to claim 1, including:

(a) a plurality of storage silos configured to operably contain certain of the ingredients for producing the hot mix asphalt;

(b) first conveyor means for selectively distributing said certain of the ingredients to said plurality of storage silos; and (c) second conveyor means for selectively conveying said certain of the ingredients contained in said plurality of storage silos from said plurality of storage silos to said processing means.

14. The system according to claim 13, wherein each of said plurality of storage silos are rectangularly shaped such that said plurality of storage silos can be compactly spaced in side-by-side abutting engagement.

15. The system according to claim 14, including enclosure means for substantially enclosing said processing means, said filter means, said return means, said plurality of storage silos, and said first and second conveyor means.

16. The system according to claim 13, further including:

(a) a plurality of loadout silos configured to operably contain hot mix asphalt produced by said processing means; and (b) third conveyor means for selectively distributing said hot mix asphalt produced by said processing means to said plurality of loadout silos.

17. The system according to claim 16, wherein:

(a) each of said plurality of storage silos are rectangularly shaped such that said plurality of storage silos can be compactly spaced in side-by-side abutting engagement; and (b) each of said plurality of loadout silos are rectangularly shaped such that said plurality of loadout silos can be compactly spaced in side-by-side abutting engagement.

18. The system according to claim 17, including enclosure means for substantially enclosing said processing means, said filter means, said return means, said plurality of storage silos, said plurality of loadout silos, and said first, second and third conveyor means.

19. The system according to claim 1, including:

(a) a plurality of loadout silos configured to operably contain hot mix asphalt produced by said processing means; and (b) conveyor means for selectively distributing said hot mix asphalt produced by said processing means to said plurality of loadout silos.

* * * * *

UNITED STATES PATENT AND TRADEMARK OFFICE

CERTIFICATE OF CORRECTION

PATENT NO. : 5,620,249

DATED : April 15, 1997

INVENTOR(S) : Joseph E. Musil

It is certified that error appears in the above-indentified patent and that said Letters Patent is hereby corrected as shown below:

On the title page: Item [56]

In the "References Cited" section, add the following:
--FOREIGN PATENT DOCUMENTS
4-161505 6/1992 Japan--

In the "References Cited" Section, delete "5,090,831" and insert therefor --5,090,813--.

In the Abstract, line 8: delete ":" and insert therefor --;-- .

In Column 1, line 54: delete ":" and insert therefor --;-- .

In Column 2, lines 43, 47, 51, 54, and 55: delete ":" and insert therefor --;-- .

In Column 2, line 61: delete "co,junction" and insert therefor --conjunction-- .

In Column 3, line 11: delete "to" .

In Column 3, line 66: delete "dram" and insert therefore --drum-- .

In Column 5, line 1: delete "," after the word "secondary" .

In Column 5, line 40: delete "fix" and insert therefor --for-- .

In Column 5, line 62: delete "dram" and insert therefor --drum-- .

In Column 7, line 36: delete "12 1" and insert therefor --121-- .

In Column 8, line 19: delete "dram" and insert therefor --drum-- .

In Column 9, line 25: delete "an" and insert therefor --art-- .

UNITED STATES PATENT AND TRADEMARK OFFICE

CERTIFICATE OF CORRECTION

PATENT NO. : 5,620,249

DATED : April 15, 1997

INVENTOR(S) : Joseph E. Musil

It is certified that error appears in the above-indentified patent and that said Letters Patent is hereby corrected as shown below:

In Column 11, line 6: delete "dram" and insert therefor --drum-- .

In Column 12, line 8: delete "dram" and insert therefor --drum-- .

In Column 12, line 19: delete "dram" and insert therefor --drum-- .

In Column 13, line 17: delete "I" and insert therefor --1-- .

In Column 15, line 4: delete "6500" and insert therefor --650-- .

In Column 15, line 9: delete "pans" and insert therefor --parts-- .

Signed and Sealed this

Sixteenth Day of September, 1997

*Attest:*

Bruce Lehman

BRUCE LEHMAN

*Attesting Officer*

*Commissioner of Patents and Trademarks*